US007364056B2

(12) United States Patent
Boaron

(10) Patent No.: US 7,364,056 B2
(45) Date of Patent: Apr. 29, 2008

(54) APPARATUS FOR WEARING SOCKS

(76) Inventor: Roiy Boaron, 51 Remax Street, Herstelia (IL) 46288

( * ) Notice: Subject to any disclaimer, the term of this patent is extended or adjusted under 35 U.S.C. 154(b) by 0 days.

(21) Appl. No.: 11/172,705

(22) Filed: Jun. 30, 2005

(65) Prior Publication Data

US 2006/0027612 A1 Feb. 9, 2006

(30) Foreign Application Priority Data

Jul. 1, 2004 (IL) ..... 162824

(51) Int. Cl.
*A47G 25/90* (2006.01)

(52) U.S. Cl. ..... 223/111

(58) Field of Classification Search ..... 223/111–119
See application file for complete search history.

(56) References Cited

U.S. PATENT DOCUMENTS 2,828,057 A * 3/1958 MacLauchlan ..... 223/111
4,238,061 A * 12/1980 Marchetti et al. ..... 223/111
5,593,071 A * 1/1997 Lusk ..... 223/112
5,894,970 A * 4/1999 Belkin et al. ..... 223/112
6,951,224 B2 * 10/2005 Garrett ..... 135/66

FOREIGN PATENT DOCUMENTS

DE 20306424 U1 * 7/2003

* cited by examiner

*Primary Examiner*—Gary L. Welch
*Assistant Examiner*—Andrew W Sutton
(74) *Attorney, Agent, or Firm*—Roach Brown McCarthy & Gruber, P.C.; Kevin D. McCarthy

(57) ABSTRACT

An apparatus for aiding in wearing on a sock is disclosed. A preferred embodiment comprises a base having proximate and distal ends; an elongated caddy having a U-shape cross-section, a first end of said caddy being connected to the base at a location close to its distal end; a connecting pivot for pivotally connecting said first end of the elongated U-shape caddy with said base at a location close to the base distal end, allowing rotation of said elongated caddy about said pivot; and connecting means for affixing said base to a fixed or heavy article, such as a furniture article.

13 Claims, 15 Drawing Sheets

APPARATUS FOR WEARING SOCKS

FIELD OF THE INVENTION

The present invention relates to the field of invalid aids and appliances. More particularly, the invention relates to an apparatus for self-serving use by invalids or handicapped persons and especially for use by invalids with amputated or disabled arms or by people having muscular dystrophy or tendons problems, which permits a person to apply his own stocking without any assistance.

BACKGROUND OF THE INVENTION

Thereinafter, when the term sock is mentioned, it should be understood that it refers also to stocking and vice-versa.

People with various physically limiting conditions have difficulty in dressing themselves unassisted by a second individual, limiting their ability to live independently; this at times contributes to lowered self-esteem and depression. Examples of limiting physical conditions that may contribute to such difficulties in proper and comfortable dressing include pregnancy, obesity, and diminished range of motion in the back, hip, knee, ankle, or foot; often caused by injury, disease, or surgery. One special problem for invalids, handicapped persons with amputated or disabled arms, people having muscular dystrophy or tendons problems or persons, which are recovering from a surgery, is the wearing of socks.

Many devices have been proposed having rigid rod(s) or handle(s) such as disclosed in U.S. Pat. No. 4,238,061. These normally terminate in a U-shaped or short channel-shaped member which fits inside and stretches the elasticated edge of the stocking and can be released on pulling the rod away from the foot. The patent describes a device which includes a single goose-neck handle on one end of an elongated U-shaped rod and a semi-cylindrical caddy that is pivotally attached to the opposite end of the rod. Another U.S. Patent Application number 2003/0230605A1 discloses a device for allowing physically limited persons to put on or remove socks includes an elongated U-shaped sock caddy and two rigid elongated U-shaped pivotal handles. However, this does not provide a smooth action when pulling the sock around the heel. UK Patent Application No. 2316600A presents a sock aid which consists of a wire frame with an outer covering having a pulling strap and a strengthening strip. The user must place his foot in the entry to the heel end and pull the aid and sock assembly onto his foot by means of the strap. All the above inventions are unusable for an invalid or a handicapped person with amputated or disabled arms or for persons having muscular dystrophy or tendons problems.

Also there are very few devices like the one presented in U.S. Pat. No. 5,082,154 for assisting an individual in donning hosiery. When a user wants to slip one of their feet into an article of hosiery, he (or his assistant) needs to slip the sides of the article of hosiery over the rounded edges of the tops of the support leg members to create an expanded opening in the inverted article of hosiery. Since, a three legs hosiery support unit is not pivotally attached to the base member, it will be very difficult and may be impossible for a person having muscular dystrophy or tendons problems or for an invalid or a handicapped person with amputated or disabled arms to use this apparatus without someone else assistance. In order to slip a foot into the opening, which is slanted very much toward the horizontal axis, the handicapped person, if he lies down, can not remain in this position and must get up in order to wear his sock. If the user is an invalid or a handicapped person with amputated or disabled arms or persons having muscular dystrophy or tendons problems etc., he can not get up by himself, but only with the help of his assistant. Moreover, U.S. Pat. No. 5,082,154 presents the device that can easily slide aside while the wearing sock process since it lacks a ribbon or any other tool for providing counter force to the socks wearing action.

SU 694,190T also presents an apparatus for assisting invalids in stocking. But this apparatus has even more disadvantages, than the one described in U.S. Pat. No. 5,082,154. For the reason described above, it is almost impossible for an invalid or a handicapped person with amputated or disabled arms or persons having muscular dystrophy or tendons problems, to use this device, while the user lies down.

There is, therefore, a need for an apparatus which will aid in wearing socks or any other articles of hosiery, and which does not require the user bending, or pulling, or assistance from another person, or use of hands. Until now, none of the prior art provided a complete solution to the problem of the wearing of socks or any other article of hosiery, without any assistance of another, for the invalids or handicapped persons with amputated or disabled arms or for persons having muscular dystrophy or tendons problems or for persons with any other limiting physical condition.

The present invention seeks to overcome these difficulties by providing a stocking aid apparatus which is easy for use and simple in maintenance.

It is an object of the present invention to provide a novel stocking assisting apparatus and method having many of the advantages of the sock wearing devices mentioned heretofore and any novel features that result in a novel sock wearing apparatus which is not anticipated, rendered obvious, suggested, or implied by any of the prior art sock wearing devices, either alone or in any combination thereof.

It is another object of the present invention to provide a stocking assisting apparatus, which is of a durable and reliable construction.

It is another object of this invention to provide a stocking assisting apparatus which employs base member with a semi-cylindrical caddy for foot and leg placement that is pivotally attached to the base unit, which is provided for a pushing motion of the leg and not for a pulling motion of the user arm(s).

Moreover, it is another object of this invention to provide a stocking assisting apparatus which utilizes the elasticity of hosiery to provide easy fit for legs of different sizes.

It is also another object of this invention to provide a stocking assisting apparatus which is useful with socks of any size or type.

It is still another object of the present invention to provide a stocking assisting apparatus, which may be easily and efficiently manufactured and marketed.

It is further object of the present invention to provide a stocking assisting apparatus which is susceptible of a low cost of manufacture with regard to both materials and labor, and which accordingly is then susceptible of low prices of sale to the consuming public, thereby making such socks wearing device economically available to the buying public.

It is still another object of this invention to provide a stocking assisting apparatus which does not, in use, require the user to bend his back.

It is still a further object of the present invention to provide a stocking assisting apparatus which provides in the apparatuses and methods of the prior art some of the advantages thereof, while simultaneously overcoming some of the disadvantages normally associated therewith.

Also, it is a further object of the present invention to provide a stocking assisting apparatus that would aid a user in putting on socks while the user is an invalid, a handicapped person with amputated or disabled arms, a person having muscular dystrophy or tendons problems, a user that is recovering from a surgery or person with any other limiting physical condition.

Moreover, it is a further object of the present invention to provide a stocking assisting apparatus which includes a sock wearing assembly for keeping a sock open for facilitating insertion of a foot into the sock.

It is still a further object of the present invention to provide a stocking assisting apparatus that would minimize the time and efforts it takes for invalid, or a handicapped person with amputated or disabled arms, or a person after a surgery, or an elderly user, or a user having any other physically limiting condition to put on socks.

These and further objects of the present invention will be more readily appreciated when considering the following disclosure and appended drawings.

SUMMARY OF THE INVENTION

The present invention relates to an apparatus for aiding in wearing on a sock which comprises: (a) a base having proximate and distal ends; (b) an elongated caddy having a U-shape cross-section, a first end of said caddy being connected to the base at a location close to its distal end; (c) a connecting pivot for pivotally connecting said first end of the elongated U-shaped caddy with said base at a location close to the base distal end, allowing rotation of said elongated caddy about said pivot; and (d)

Connecting means for affixing said base to a fixed or heavy article, such as a furniture article.

It should be noted that the terms "proximate" and "distal" ends of the base are defined relative to the user location.

Preferably, said caddy has a semi-cylindrical cross-sectional shape.

Preferably, the upper and the lower surfaces of said base are flat.

Preferably, said caddy has a smooth interior concavity.

Preferably, said elongated U-shaped semi-cylindrical caddy is composed of at least one U-shaped wire with connecting wires.

Preferably, said elongated caddy has rounded edges at its second end.

Preferably, said connecting means comprise a ribbon which is affixed to the base close to said proximate end.

Preferably, the ribbon is attached to the base close to its proximate end by two U-shaped connecting elements.

Preferably, said pivot defines a generally transverse axis with respect to the base.

Preferably, said elongated caddy further comprises a plate at its first end, and the said pivot connects said plate to said base.

Preferably, said elongated U-shaped semi-cylindrical caddy is connected to said pivot by means of welding.

Preferably, said apparatus is fabricated from materials, such as plastic, aluminum, stainless steel or wood.

Figure 1A:
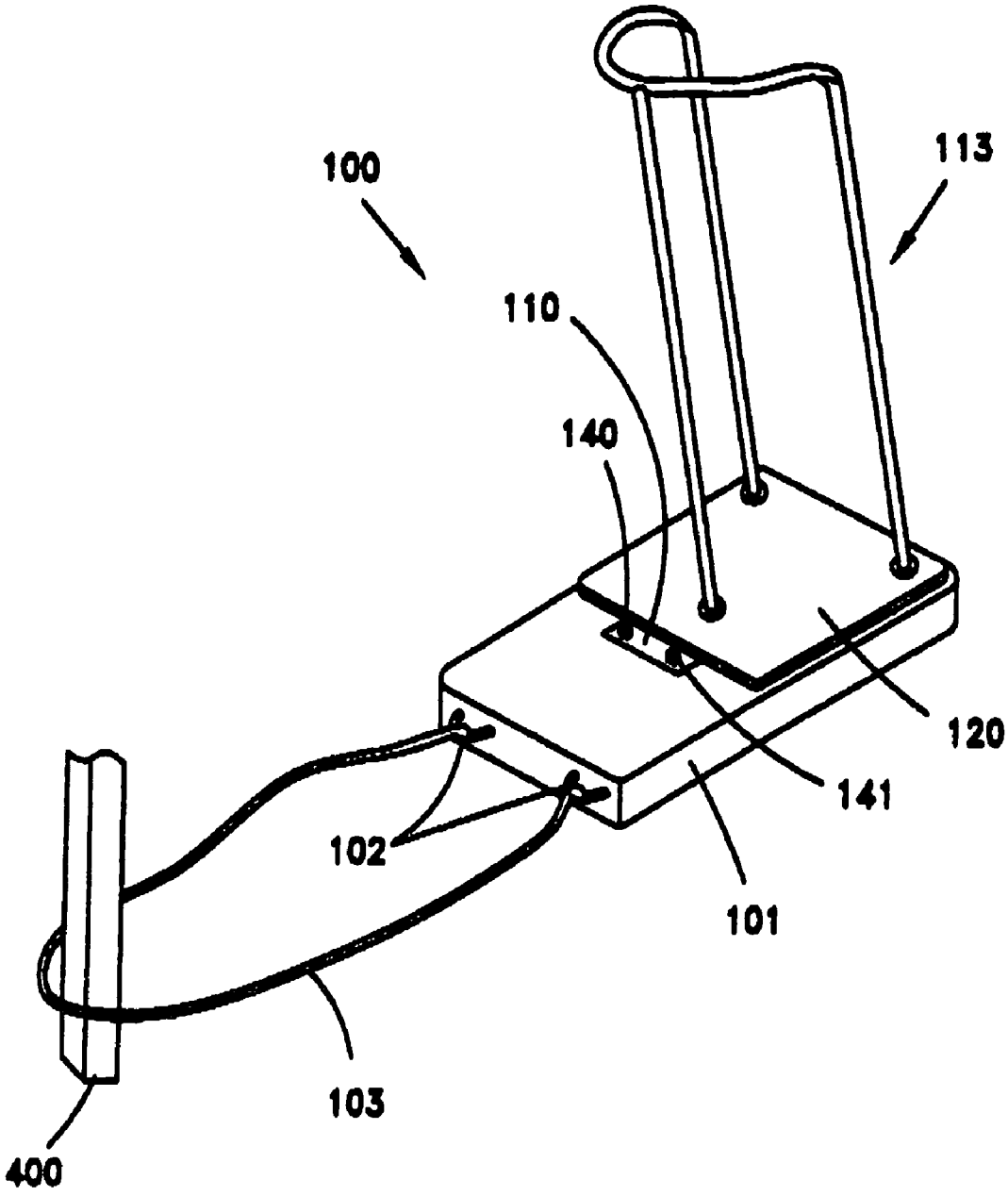
FIG. 1A is a perspective illustration of the apparatus constructed with the principles of the invention without a sock applied thereto according to one embodiment of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PREFERRED EMBODIMENTS

In the following detailed description, numerous specific details are set forth in order to provide a thorough understanding of the invention. However it will be understood by those of ordinary skill in the art that the present invention may be practiced without these specific details. In other instances, well-known methods, procedures, components and circuits have not been described in detail so as not to obscure the present invention.

Figure 1B:
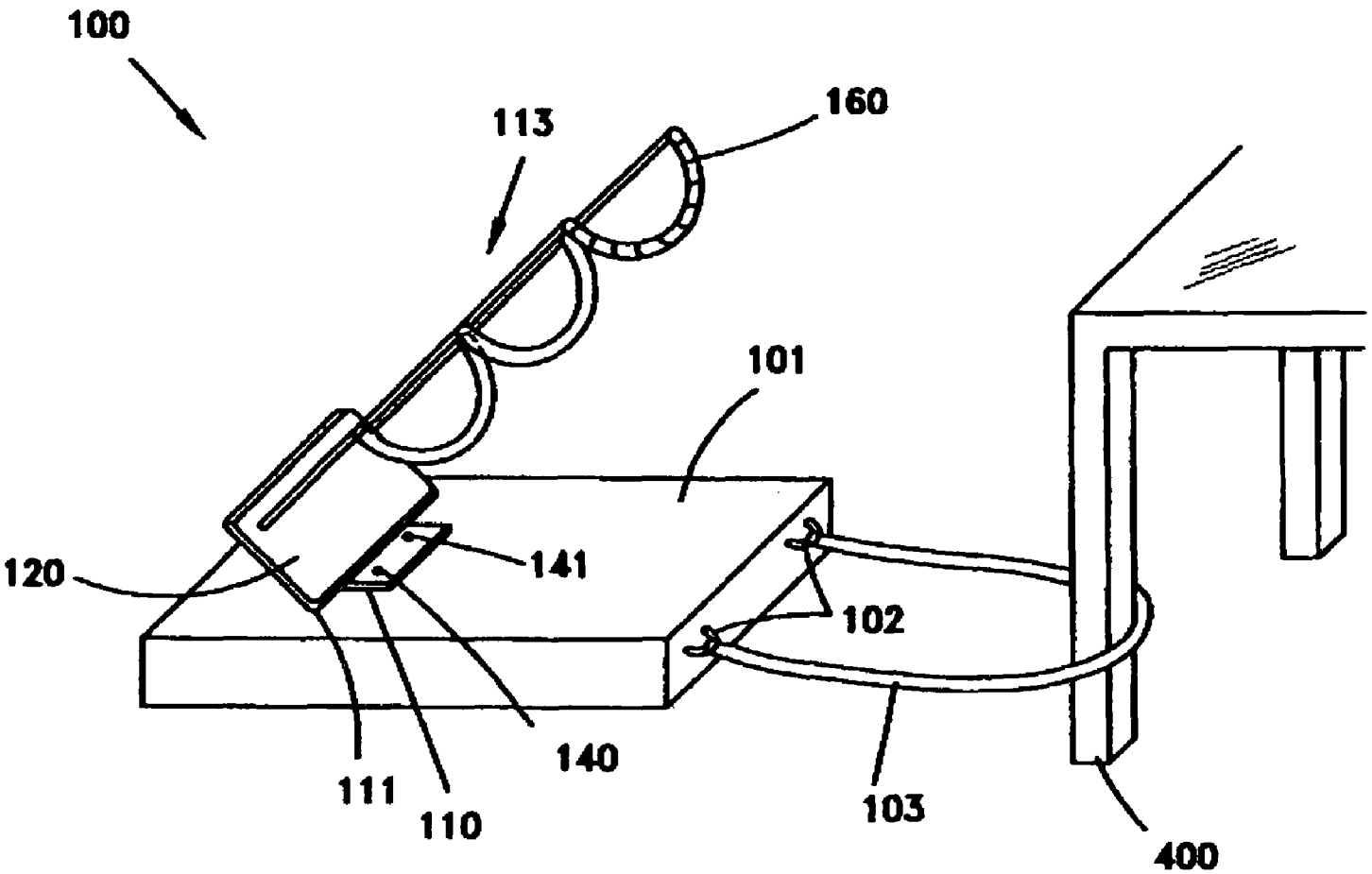
FIG. 1B is a perspective illustration of the apparatus constructed with the principles of the invention without a sock applied thereto according to another embodiment of the invention.
Figure 1C:
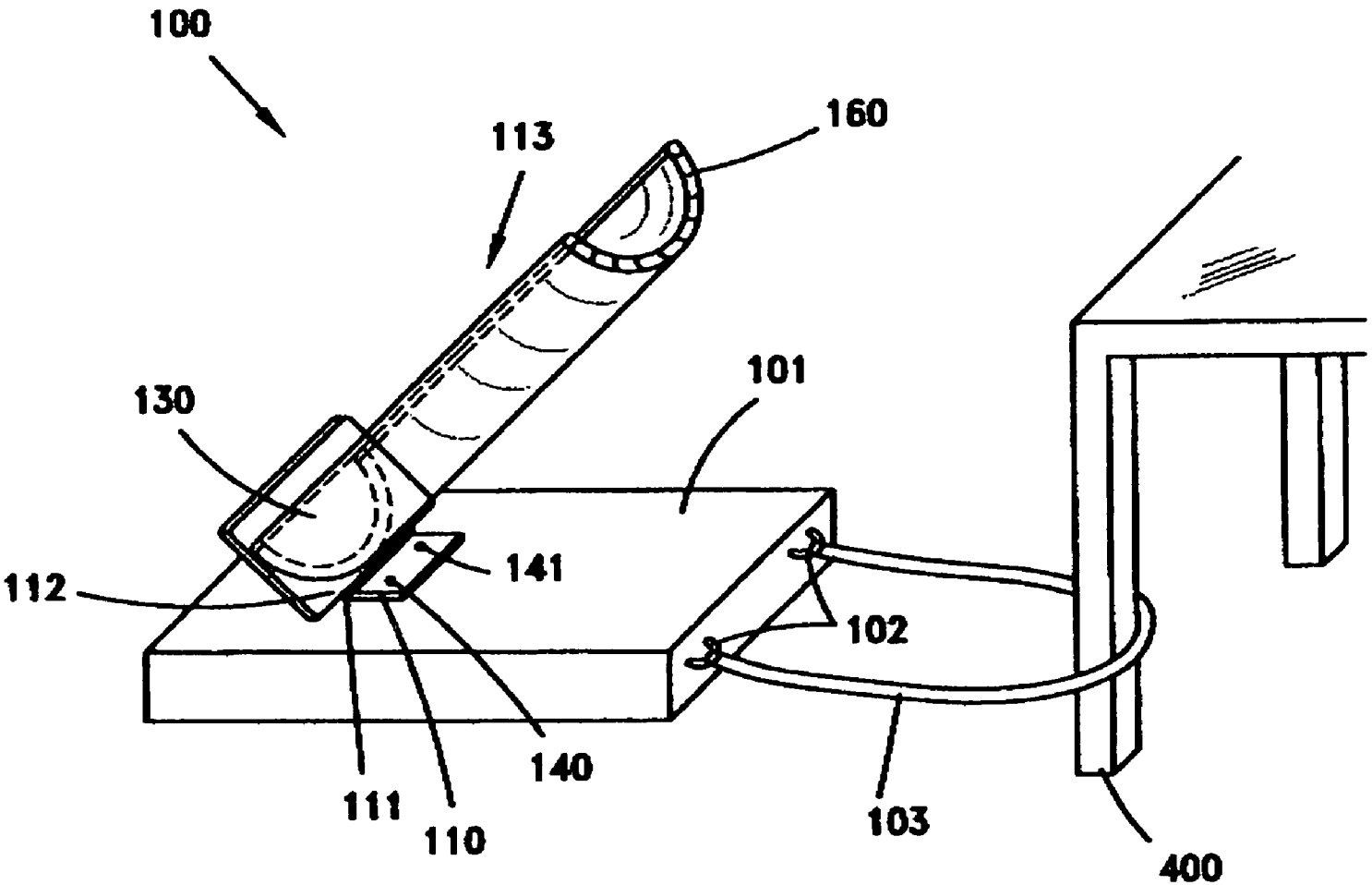
FIG. 1C is a perspective illustration of the apparatus according to still another embodiment of the invention without a sock applied thereto.

Reference is now made to FIG. 1A, FIG. 1B and FIG. 1C; they are perspective illustrations of the apparatus constructed with the principles of the invention without a sock applied thereto according to embodiments of the invention. The apparatus 100 comprises a base 101 and an elongated U-shaped semi-cylindrical caddy 113 as shown, for foot and leg placement with rounded upper edges 160 that is pivotally connected by a pin 111 to a base plate 110. The base plate 110 is attached to base 101 by two screws 140 and 141. The apparatus also comprises a ribbon 103 that is attached to the base, for example, by means of two U-shaped portions 102. The ribbon 103 is fixed before the apparatus' use to a piece of furniture as shown, or to any other fixed object for getting counter force to the sock wearing action. In FIG. 1B the elongated U-shaped semi-cylindrical caddy 113 is composed of U-shaped wire frame.

Figure 1E:
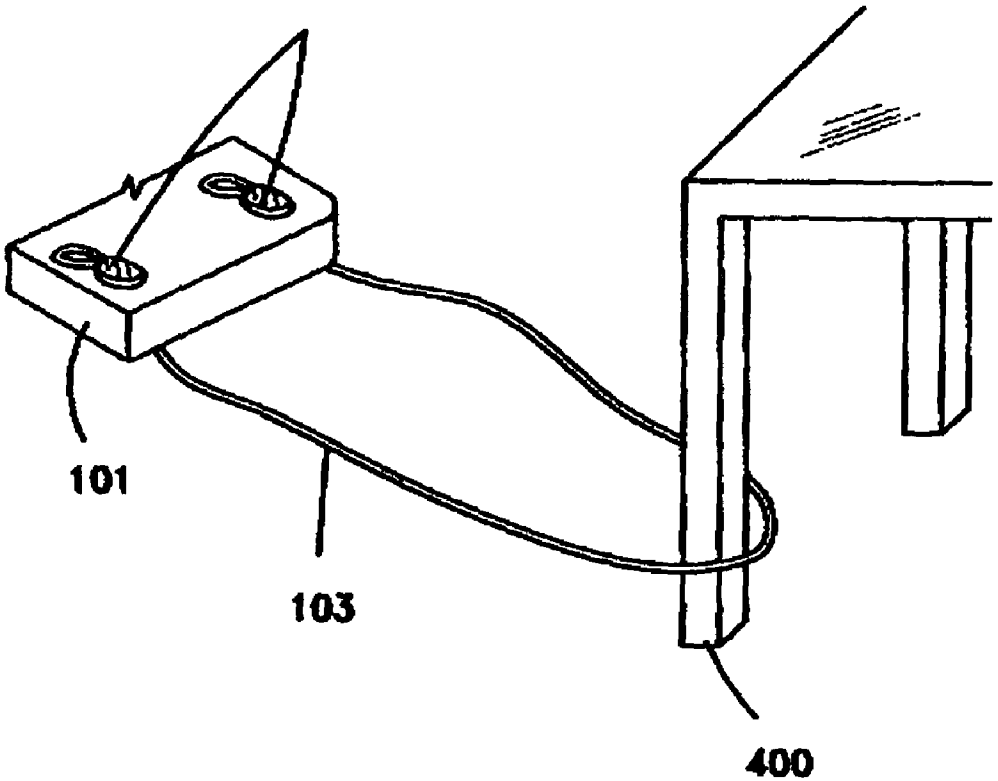
FIG. 1E is a perspective illustration of a ribbon attachment to the base according to still another embodiment of the invention.
Figure 1D:
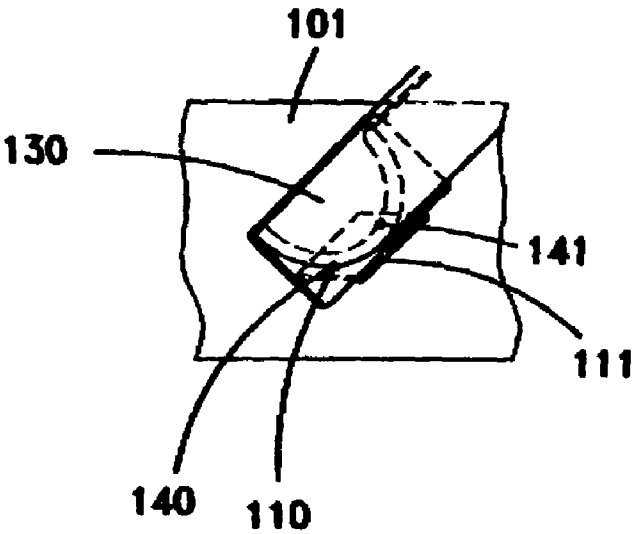
FIG. 1D is a perspective illustration of a pivotally attachment of an elongated U-shaped caddy to a base according to still another embodiment of the invention.

FIG. 1D is a perspective illustration of a pivotally attachment of the elongated U-shaped caddy 113 to the base 101 according to still another embodiment of the invention.

FIG. 1E is a perspective illustration of a ribbon attachment to the base 101 according to still another embodiment of the invention. The ribbon 103 may be attached to the base 101 by means of two knots 117 instead of an attachment by means of two U-shaped portions 102.

Figure 2:
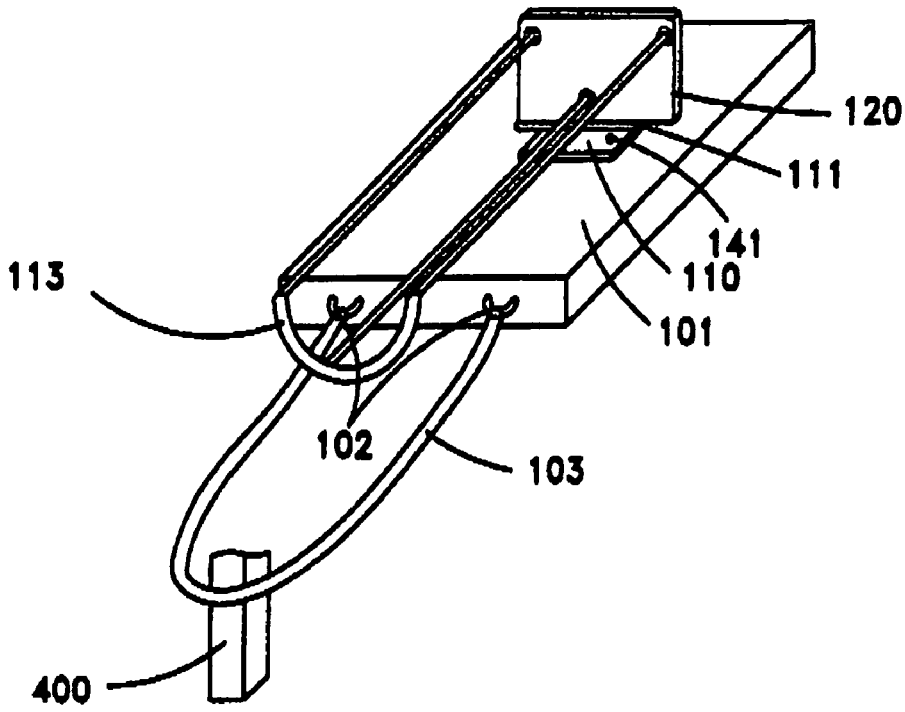
FIG. 2 is a perspective illustration of the apparatus without a sock applied thereto as viewed from the user's side.

FIG. 2 is a perspective illustration of the apparatus without a sock applied thereto as viewed from the user's side. In this figure the semi-cylindrical caddy 113 is situated in a horizontal position. The ribbon 103 is stretched to a piece of furniture 400 for getting counter force to the stocking wearing action.

Figure 3A:
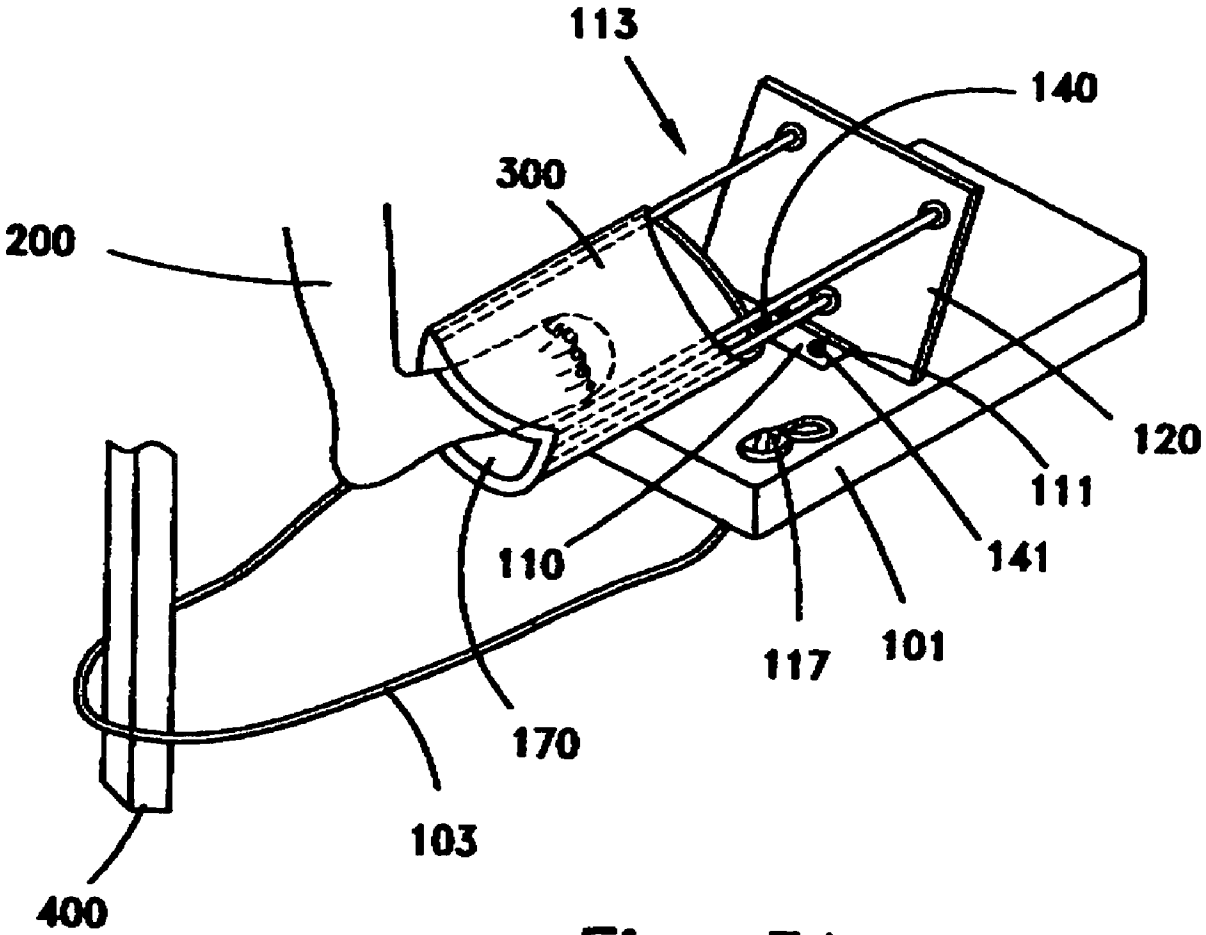
FIG. 3A to FIG. 3C are perspective illustrations of the consequent steps in the sock wearing process.
Figure 3B:
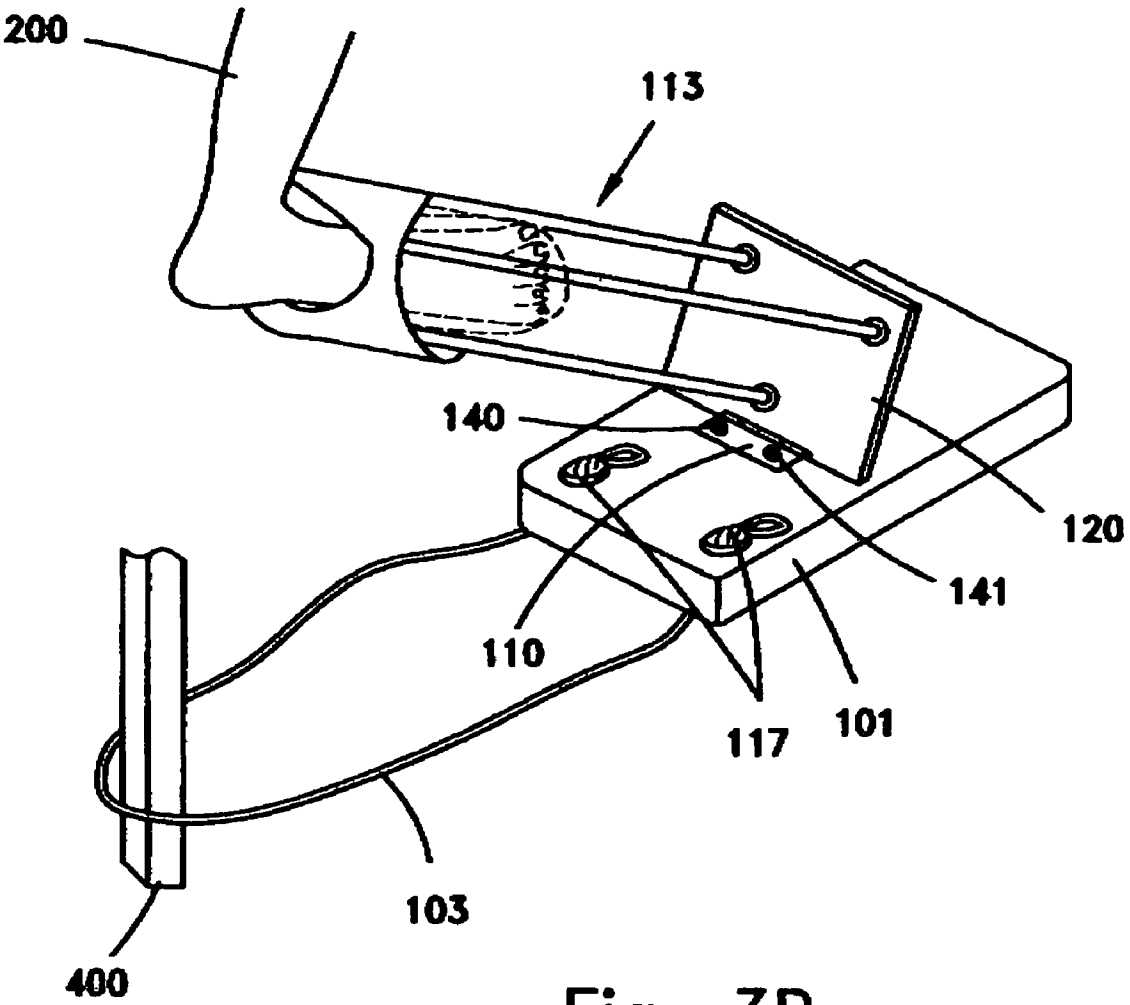
Figure 3C:
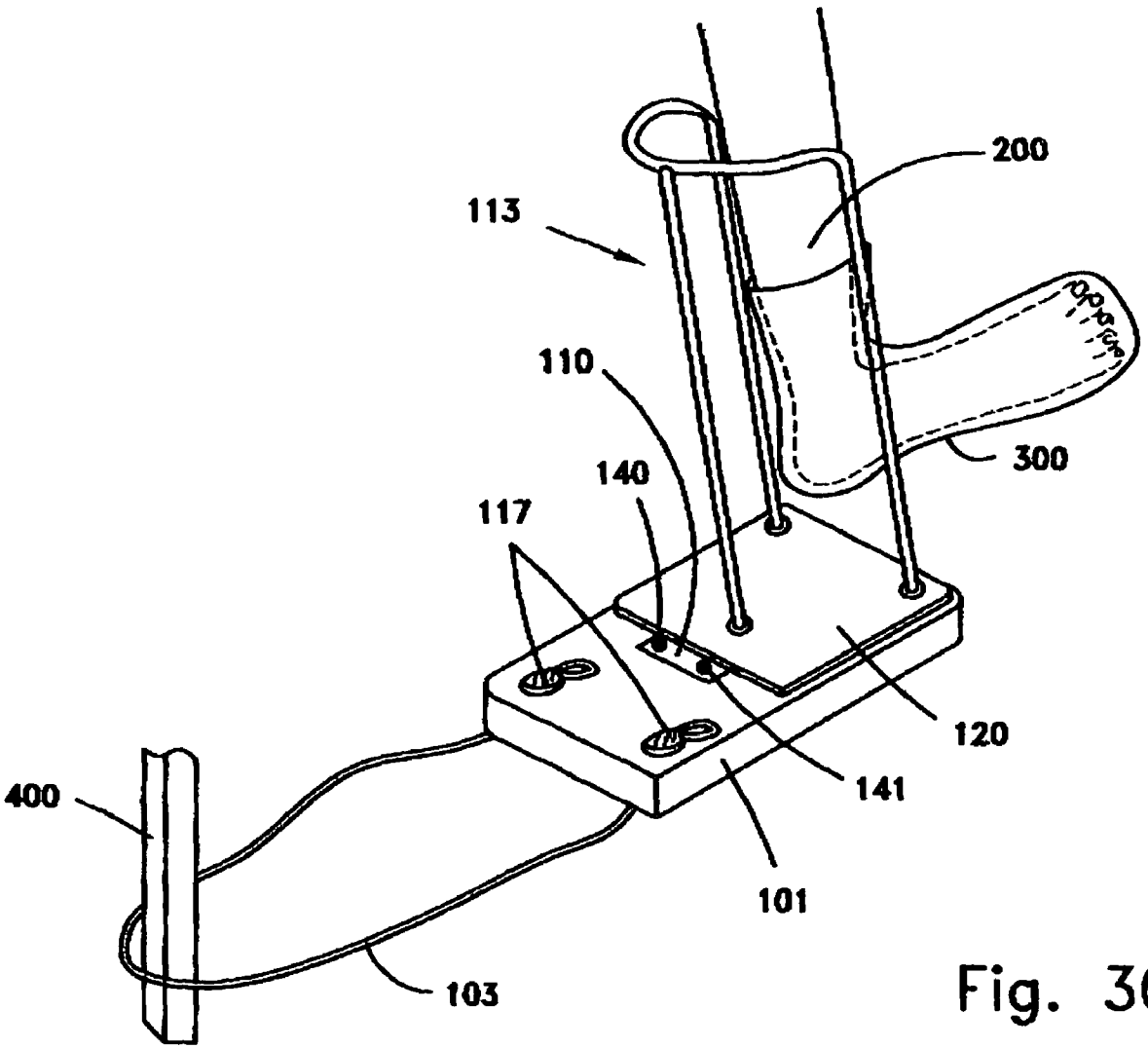

FIG. 3A to FIG. 3C are perspective illustrations of the consequent steps in the socks wearing process. The sides of the article of hosiery were slipped over the rounded upper edges 160 of the elongated U-shaped semi-cylindrical caddy 113 in order to create an expanding opening 170 in the inverted article of hosiery. Again the ribbon 103 was stretched to a piece of furniture 400 for getting counter force to the stocking wearing action. After a sock 300 was draped about the elongated U-shaped semi-cylindrical caddy 113, the user places his foot 200 in the entry, and begins to push his foot 200 inside the elongated U-shaped semi-cylindrical caddy 113 as described in details in FIG. 3A. As the user continues to push his foot 200 into the sock 300, the sock 300 is gradually slipped out of the semi-cylindrical caddy 113 and gradually fits the user's foot 200 until the user fully inserts his toes into the toe portion of the sock and the his heel into the heel portion of the sock, continually pushing his foot 200 inside the elongated U-shaped semi-cylindrical caddy 113. Also as the user continues to push his foot 200 into the sock 300, the elongated U-shaped semi-cylindrical caddy 113 rotates by means of pin 111 in relation to the foot 200 position, and finally rises to the vertical position. A ribbon 103 that is attached to base 101 by means of two U-shaped portions 102 gives counter force during all the stages of the sock's wearing process in order that the base unit 101 will not slip on the surface that the latter is situated on. Also, the rounded upper edges 160 of the elongated U-shaped semi-cylindrical caddy 113 enable smooth stocking wearing process.

Figure 4A:
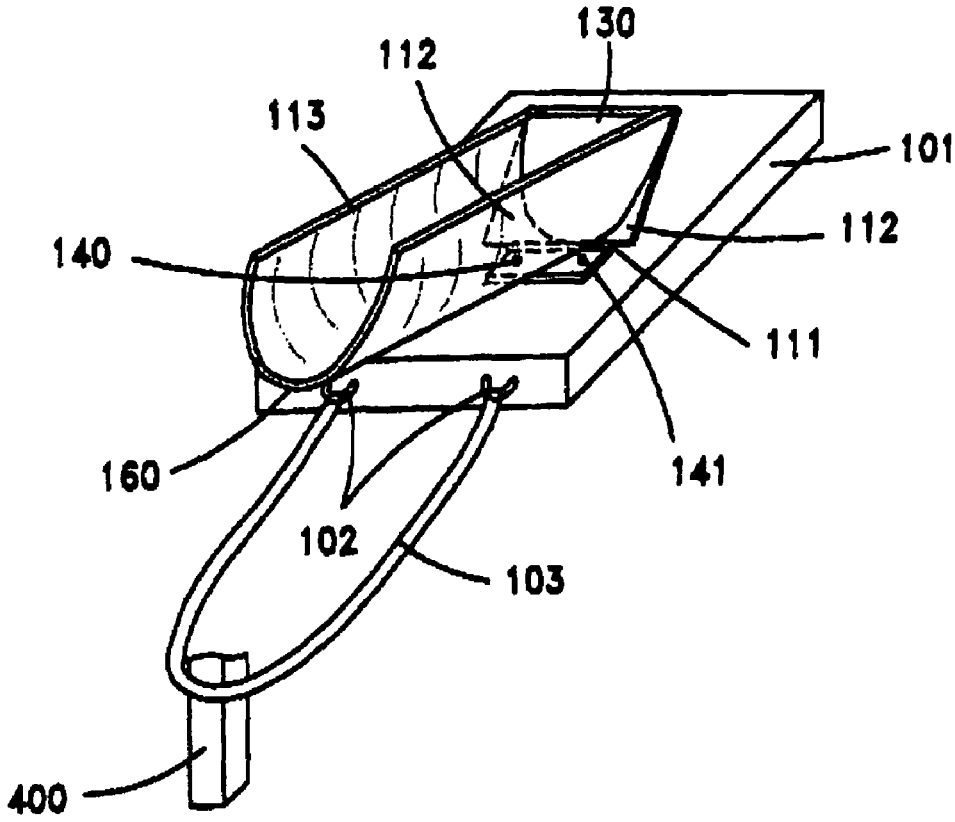
FIG. 4A to FIG. 4D are perspective illustrations of the different embodiments of the present invention.
Figure 4B:
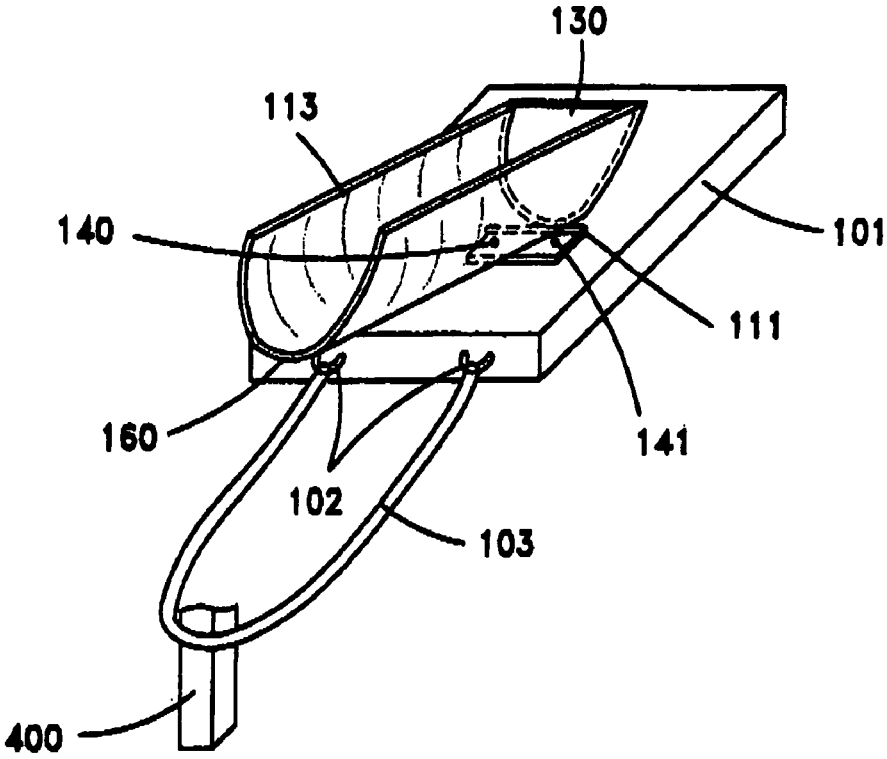
Figure 4C:
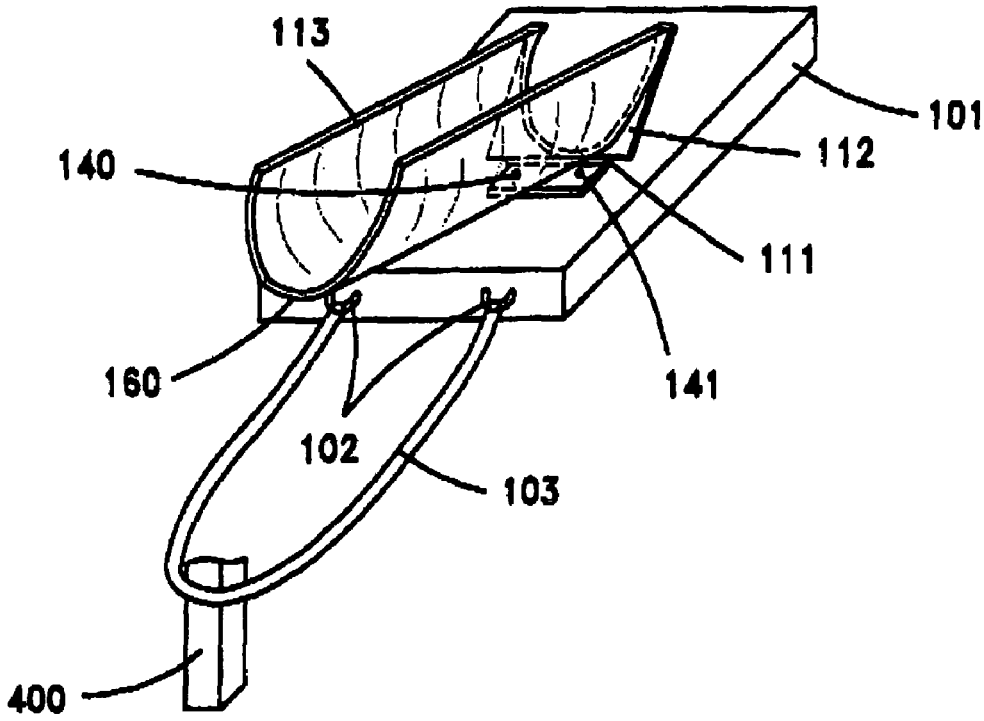
Figure 4D:
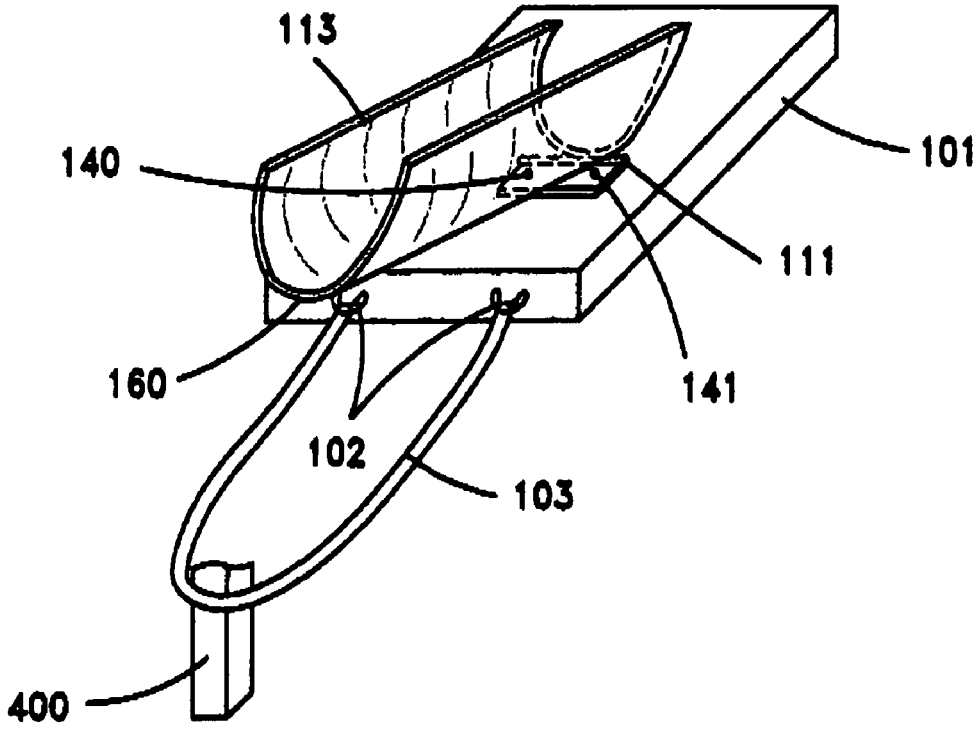

FIG. 4A to FIG. 4D are perspective illustrations of the different embodiments of the present invention. In the embodiment of FIG. 4A, the lower end of the elongated U-shaped semi-cylindrical caddy 113 is attached to end plate 130 which may be rectangular, for limiting foot movement,. End plate 130 in turn is attached to connecting plate 112, which is pivotally connected to base plate 110 (FIG. 3A). In the embodiment of FIG. 4C, the lower end of caddy 113 is attached to connecting plate 112, which has a U-shaped interior surface matching the shape of caddy 113 and an outer rectangular configuration, to allow a foot to extend beyond the length of caddy 113. Connecting plate 112 is attached to pin 111. Also the length of the pin 111 can vary and it may be longer or shorter according to the specific embodiment. In the embodiments on FIG. 4B and FIG. 4D, the elongated U-shaped semi-cylindrical caddy 113 may be connected to the pin 111 by means of welding or by means of any other suitable connection.

It should be noted that the ribbon 103 in all embodiments should be fabricated from a relatively strong flexible material. Also, all the following details in all embodiments that comprise plates 112,130 and 110, elongated U-shaped semi-cylindrical caddy 113, pin 111, two U-shaped portions 102 and base 101 should preferably be fabricated from a relatively strong material.

Figure 5:
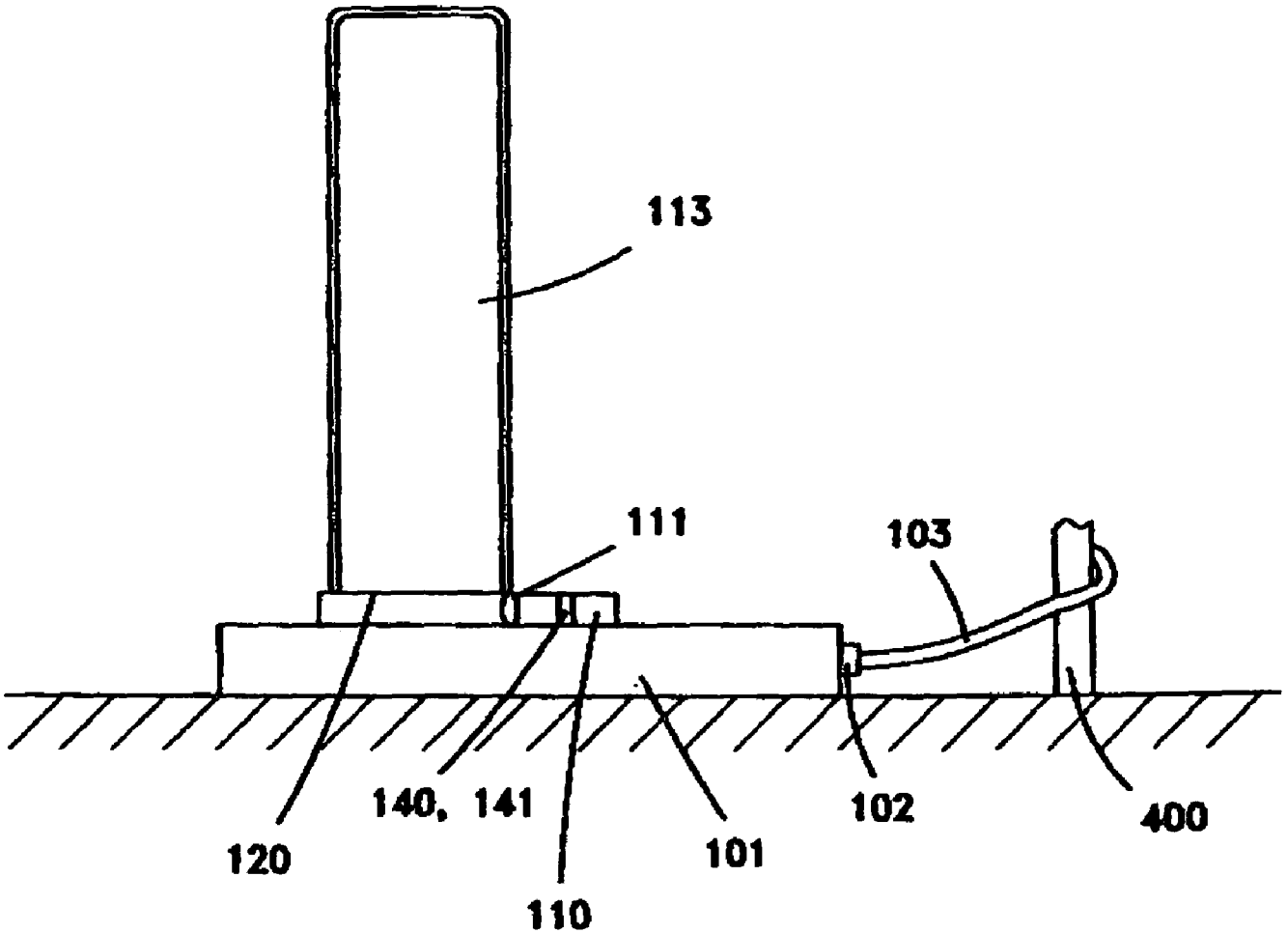
FIG. 5 is a side detailed view of the device while an elongated U-shaped semi-cylindrical caddy is in vertical position according to an embodiment of the present invention.

Reference is now made to FIG. 5 that is a side detailed view of the device, while the elongated U-shaped semi-cylindrical caddy 113 is in a vertical position. FIG. 5 shows the apparatus view after the user putted on the sock or any other article of hosiery.

Figure 6A:
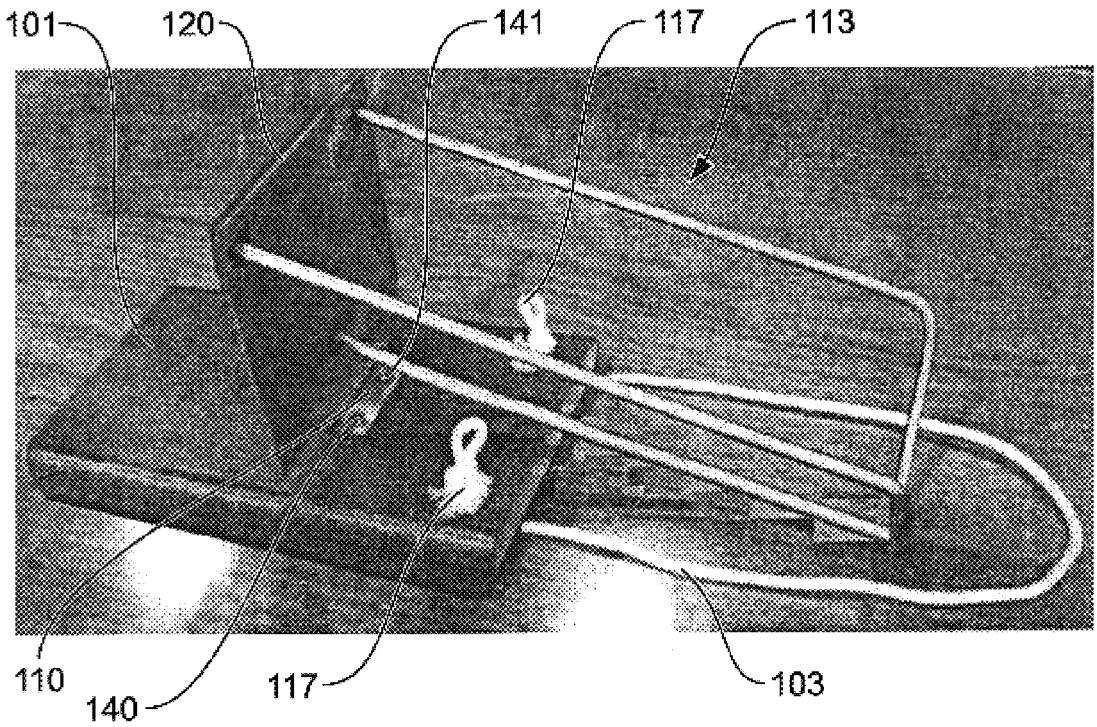
FIG. 6A and FIG. 6B are photo-examples of one embodiment of the invention.
Figure 6B:
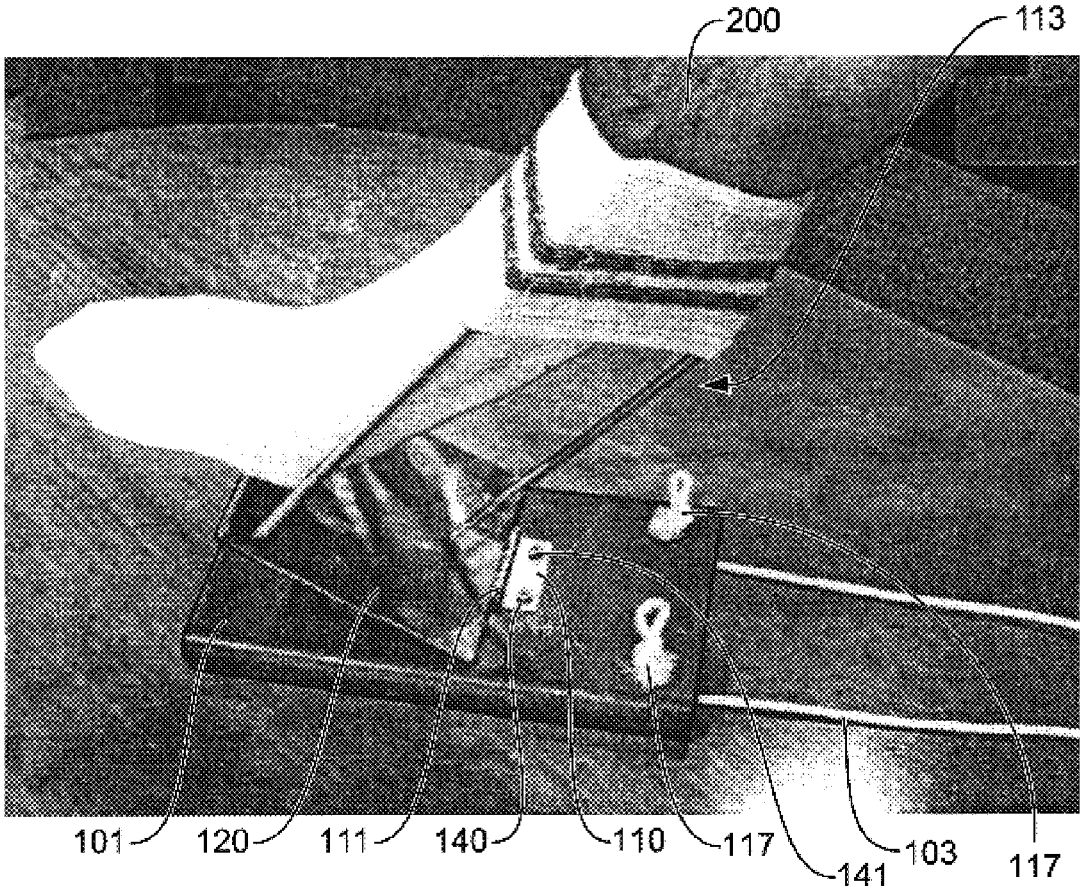

FIG. 6A and FIG. 6B are photo-examples of one embodiment of the invention.

FIG. 6B shows the sock applied the user foot and the elongated U-shaped semi-cylindrical caddy 113 rotating by means of the pin 111 to the vertical position.

It is seen that none of the operations described above requires the wearer to bend down or lean forward, so that any difficulties related to a bending or stretching movements which the wearer could have are eliminated.

It should be understood that the present invention may be used in a variety of applications. The presently disclosed embodiments are therefore considered in all respects to be illustrative and not restrictive. Also, it is to be understood that the phraseology and terminology employed herein are for the purpose of description and should not be regarded as limiting.

The invention claimed is:

1. An apparatus for aiding in donning a sock, comprising:

a) a base having proximate and distal ends;

b) an elongated caddy having U-shape cross-section, a first end of said caddy being connected to said base at a location close to said distal end and a second end of said caddy over which a sock can be draped being displaceable with respect to said base;

c) a connecting pivot for pivotally connecting said first end of the elongated U-shaped caddy with said base at a location close to the base distal end, allowing rotation of said elongated caddy about said pivot; and d) counter weight means by which said base is coupled to a fixed or heavy article, such as a furniture article, wherein said caddy is upwardly pivotable from an initial substantially horizontal disposition, upon insertion of a foot within a sock draped over the second end of said caddy, until a disposition at which said sock is released from said caddy after being fully donned on said foot and wherein said connecting means comprise a ribbon which is affixed to the base close to its proximate end.

2. Apparatus according to claim 1, wherein said caddy has a semi-cylindrical cross-sectional shape.

3. Apparatus according to claim 1, wherein the upper and the lower surfaces of said base are flat.

4. Apparatus according to claim 1, wherein said caddy has a smooth interior concavity.

5. Apparatus according to claim 1, wherein said elongated caddy is made of at least one U-shaped wire, and additional connecting wires which altogether define the shape of the caddy.

6. Apparatus according to claim 1, wherein said elongated caddy has rounded edges at its second end.

7. Apparatus according to claim 1, wherein the ribbon is attached to the base close to its proximate end by two U-shaped connecting elements.

8. Apparatus according to claim 1, wherein said pivot defines a generally transverse axis with respect to the base.

9. An apparatus for aiding in donning a sock, comprising:

a) a base having proximate and distal ends;

b) an elongated caddy having U-shape cross-section, a first end of said caddy being connected to said base at a location close to said distal end and a second end of said caddy over which a sock can be draped being displaceable with respect to said base;

c) a connecting pivot for pivotally connecting said first end of the elongated U-shaped caddy with said base at a location close to the base distal end, allowing rotation of said elongated caddy about said pivot; and d) counter weight means by which said base is coupled to a fixed or heavy article, such as a furniture article, wherein said caddy is upwardly pivotable from an initial substantially horizontal disposition, upon insertion of a foot within a sock draped over the second end of said caddy, until a disposition at which said sock is released from said caddy after being fully donned on said foot and wherein said elongated caddy further comprises a plate at its first end and said pivot connects said plate to said base.

10. Apparatus according to claim 1, wherein said elongated U-shaped semi-cylindrical caddy is connected to said pivot by means of welding.

11. Apparatus according to claim 6, wherein the rounded edges of the caddy face the base when the caddy is at its initial disposition.

12. Apparatus according to claim 9, wherein the plate is U-shaped and is attached to the first end of the caddy.

13. A method for donning hosiery, comprising the steps of:

a) providing an elongated caddy having a U-shape cross-section, a first end of said caddy being pivotally connected to a base and a second end of said caddy being displaceable with respect to said base;

b) coupling a flexible elongated element affixed to said base to a fixed or heavy article;

c) draping hosiery in inside-out fashion over the second end of said caddy and extending a toe portion of said draped hosiery towards the first end of said caddy;

d) positioning said caddy to be in a substantially horizontal disposition;

e) placing a foot within said hosiery at the second end of said caddy and causing said caddy to pivot upwardly;

f) pushing the foot within said caddy towards said first end thereof until toes of the foot are inserted in the toe portion of said hosiery and the heel of the foot is inserted in a heel portion of said hosiery; and g) lowering the foot after said hosiery is completely donned on the foot and said hosiery is released from the second end of said caddy, said caddy subsequently being pivotally lowered to said substantially horizontal disposition.

* * * * *